US009954318B2

(12) United States Patent
Lee et al.

(10) Patent No.: US 9,954,318 B2
(45) Date of Patent: Apr. 24, 2018

(54) PIN ALIGNMENT AND PROTECTION IN COMBINED CONNECTOR RECEPTACLES

(71) Applicant: APPLE INC., Cupertino, CA (US)

(72) Inventors: Jae Hwang Lee, San Jose, CA (US); James M. Jeon, Cupertino, CA (US); Mahmoud R. Amini, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/845,113

(22) Filed: Sep. 3, 2015

(65) Prior Publication Data

US 2017/0070007 A1 Mar. 9, 2017

(51) Int. Cl.
*H01R 13/648* (2006.01)
*H01R 13/659* (2011.01)
*H01R 27/02* (2006.01)

(52) U.S. Cl.
CPC ..... *H01R 13/659* (2013.01); *H01R 27/02* (2013.01)

(58) Field of Classification Search
CPC ..... H01R 13/659; H01R 27/02
USPC ..... 439/79, 541.5, 607.24
See application file for complete search history.

*Primary Examiner* — Khiem Nguyen
(74) *Attorney, Agent, or Firm* — Kilpatrick Townsend & Stockton, LLP

(57) ABSTRACT

Combined connector receptacles that provide isolation between individual connector receptacles and have structures arranged to reduce or eliminate damage to through-hole contact portions during insertion of the combined connector into a board.

22 Claims, 8 Drawing Sheets

PIN ALIGNMENT AND PROTECTION IN COMBINED CONNECTOR RECEPTACLES

BACKGROUND

The number of types of electronic devices that are commercially available has increased tremendously the past few years and the rate of introduction of new devices shows no signs of abating. Devices, such as tablet, laptop, netbook, desktop, and all-in-one computers, cell, smart, and media phones, storage devices, portable media players, navigation systems, monitors, and others, have become ubiquitous.

Power and data may be provided from one device to another over cables that may include one or more wire conductors, fiber optic cables, or other conductor. Connector inserts may be located at each end of these cables and may be inserted into connector receptacles in the communicating or power transferring devices.

These connector receptacles may be located in openings of enclosures in electronic devices. In some circumstances, it may be desirable to combine more than one connector receptacle into a single unit, which may be referred to as a combined connector receptacle.

Various problems may arise when connector receptacles are combined into a single unit. For example, contacts in one connector receptacle may convey a high-speed signal having relatively fast edges. High frequency signal components may couple onto contacts in another connector receptacle in the unit, thereby degrading the performance of the other connector receptacle. Similarly, contacts in one connector receptacle may convey a signal that is sensitive to coupling. Signal components may couple onto this contact, thereby degrading performance of that connector receptacle.

Also, contacts in a receptacle may terminate in through-hole contact portions that may be inserted into a board, such as a printed circuit board, during device assembly. Including more than one connector receptacle in a single unit may make the insertion of the through-hole contact portions more complicated. Specifically, the number of contacts and corresponding through-hole contact portions may increase, thereby making alignment of the through-hole contact portions more difficult.

Thus, what is needed are combined connector receptacles that provide isolation between individual connector receptacles and have structures arranged to reduce or eliminate damage to through-hole contact portions during insertion of the combined connector into a board.

SUMMARY

Accordingly, embodiments of the present invention may provide combined connector receptacles that provide isolation between individual connector receptacles and have structures arranged to reduce or eliminate damage to through-hole contact portions during insertion of the combined connector into a board.

An illustrative embodiment of the present invention may provide isolation between connector receptacles in a combined connector receptacle unit. A combined connector receptacle may include a first assembly including one or more housings for a first connector receptacle and a second assembly including one or more housings for a second connector receptacle. Shielding may be located between the first assembly and the second assembly to isolate contacts in each connector receptacle from each other. The shielding between assemblies may be connected to further shielding around both the first and second assemblies. In a specific embodiment of the present invention, the shielding between the first connector receptacle and the second connector receptacle may include a first portion between contacting portions of contacts for the first connector receptacle and the contacting portions contacts for the second connector receptacle. The shielding may further have a second portion orthogonal to the first portion and between through-hole contact portions of the contacts for the first connector receptacle and through-hole contact portions of the contacts for the second connector receptacle.

These and other embodiments of the present invention may provide structures for aligning through-hole contact portions of the contacts in the first and second connector receptacles assemblies to each other. This alignment may aid in the insertion of the through-hole contact portions into a board supporting the combined connector receptacle. The structures may include an organizer having a number of openings, the openings including at least a first opening to accept a first through-hole contact portion of a first connector receptacle and a second opening to accept a second through-hole contact portion of a second connector receptacle.

In these and other embodiments of the present invention, the first assembly may include a first housing around a first number of through-hole contact portions of a first connector receptacle and the second assembly may include a second housing around a second number of through-hole contact portion of a second connector receptacle. The first housing may move laterally, rotationally, and vertically relative to the second housing such that the first number of through-hole contact portions may be aligned to the second number of through-hole contact portions. After alignment, an organizer may be fit over the first number of through-hole contact portions and the second number of through-hole contact portions. The combined connector receptacle may then be inserted into a board, such as a printed circuit board or other appropriate substrate.

In these and other embodiments of the present invention, a first assembly for a first connector receptacle may include a series of housings. The series of housings may include a first housing, a second housing, and a third housing where the first and third housings are approximately at right angles. The second housing may be located between the first and third housing and may be at an oblique angle relative to the first and third housings. The first housing may be attached to a tongue in a connector receptacle, while the third housing may be around at least a portion of each of a number of through-hole contact portions for the first connector receptacle. This arrangement may allow the third housing to move relative to the tongue of the connector receptacle. This, in turn, may allow the third housing to move relative to a fourth housing supporting a number of through-hole contact portions for a second connector receptacle. This may allow the through-hole contact portions for the first connector receptacle to be aligned to the through-hole contact portions for the second connector receptacle. After alignment, an organizer may be fit over the through-hole contact portions for the first connector receptacle and the through-hole contact portions for the second connector receptacle. The through-hole contact portions of the combined connector receptacle may then be inserted into a board, such as a printed circuit board or other appropriate substrate.

In these and other embodiments of the present invention, the organizer may be fit against one or more housings of the one or more connector receptacles in a combined connector receptacle unit. The through-hole contact portions of the combined connector receptacle unit may then be inserted into corresponding holes in a board, such as a printed circuit board or other appropriate substrate. In other embodiments of the present invention, the organizer may be positioned away from the housings towards ends of the through-hole contact portions. During assembly, a combined connector receptacle unit may be placed on the board such that an organizer contacts or is near the board. The combined connector receptacle unit may be pushed onto the board such that the organizer is moved towards the housings and the through-hole contact portions are pushed into corresponding openings in a board, such as a printed circuit board or other appropriate substrate.

In various embodiments of the present invention, contacts, shields, and other conductive portions of combined connector receptacles may be formed by stamping, metal-injection molding, machining, micro-machining, 3-D printing, forging, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide combined connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These combined connector receptacles may provide pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
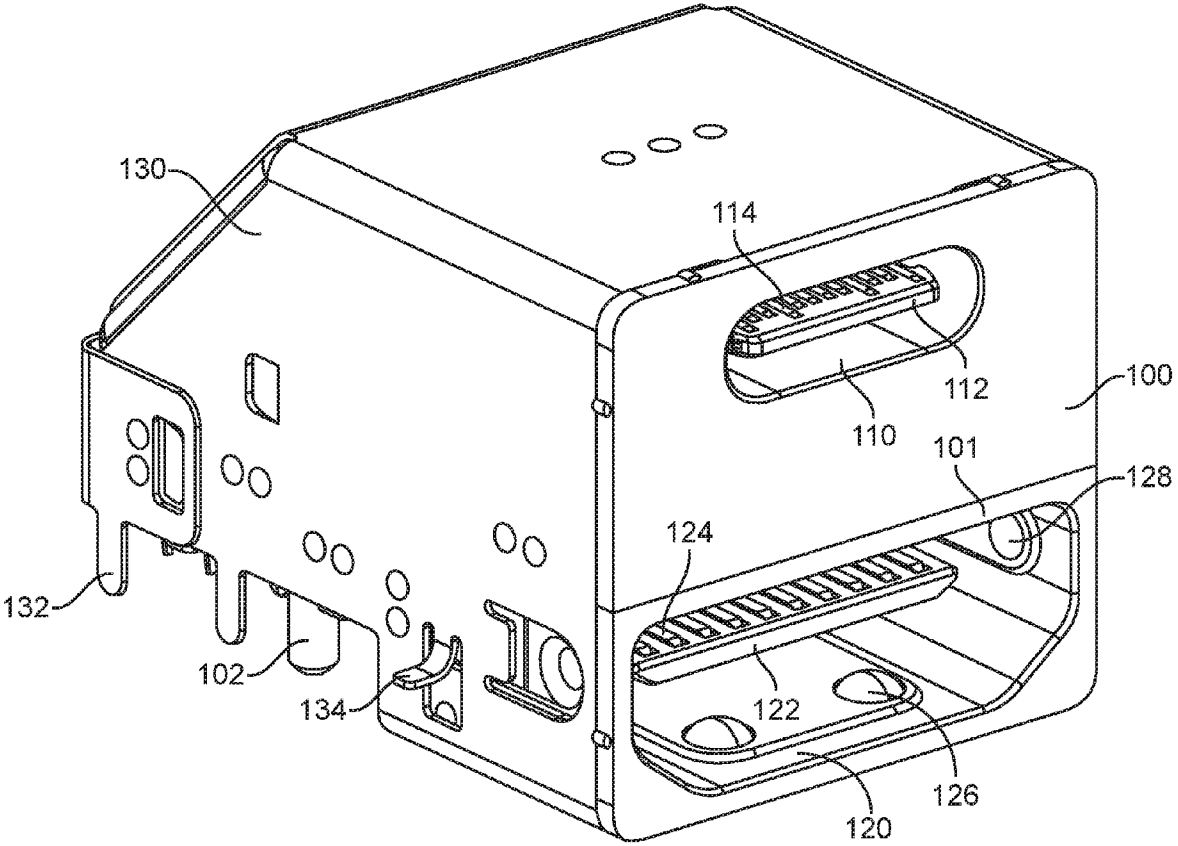
FIG. 1 illustrates a combined connector receptacle according to an embodiment of the present invention.

FIG. 1 illustrates a combined connector receptacle according to an embodiment of the present invention. This figure, as with the other included figures, is shown for illustrative purposes and does not limit either the embodiments of the present invention or the claims.

This combined connector receptacle may include upper or first housing 100 and lower or second housing 101. First housing 100 may include a first connector receptacle 110. First connector receptacle 110 may include tongue 112. Tongue 112 may support a number of contacts 114.

Lower or second housing 101 may include a second connector receptacle 120. Second connector receptacle 120 may include tongue 122. Tongue 122 may support a number of contacts 124. Electromagnetic interference (EMI) ground contacts 126 and 128 may also be included in the opening of second connector receptacle 120.

In various embodiments of the present invention, first connector receptacle 110 and second connector 120 receptacle may be various types of connector receptacles, such as one of the USB standards including USB Type-C, HDMI, DVI, Ethernet, DisplayPort, Thunderbolt, Lightning, JTAG, TAP, DART, UART, or other types of standard, non-standard, and proprietary interfaces and combinations thereof that have been developed, are being developed, or will be developed in the future. In a specific embodiment of the present invention, the first connector receptacle 110 may be a USB Type-C connector receptacle, while second connector receptacle 120 may be an HDMI connector receptacle.

Shield 130 may surround the upper or first housing 100 and the lower or second housing 101. Shield 130 may include tabs 132. Tabs 132 may be arranged to be soldered into openings of a printed circuit board or other appropriate substrate supporting this combined connector receptacle. Posts 102 may be used to provide mechanical alignment between this combined connector receptacle and a printed circuit board or other appropriate substrate. Tabs 134 may be used in mechanically aligning a height of this combined connector receptacle to a printed circuit board.

Figure 2:
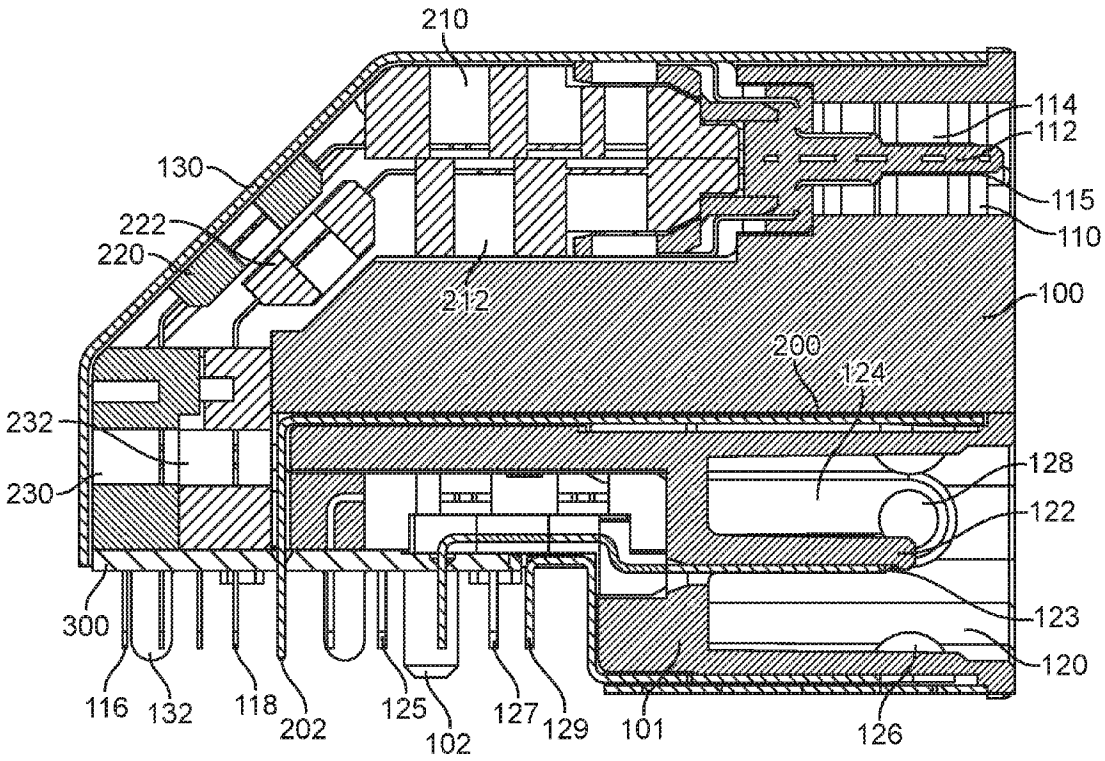
FIG. 2 illustrates a side cutaway view of a combined connector receptacle according to an embodiment of the present invention.

FIG. 2 illustrates a side cutaway view of a combined connector receptacle according to an embodiment of the present invention. As before, first or upper housing 100 may include a first connector receptacle 110. First connector receptacle 110 may include a tongue 112 supporting a number of contacts 114 on a top side and a number of contacts 115 on a bottom side. Contacts 114 and contacts 115 may include contacting portions on tongue 112. Contact portions of contacts 114 and 115 may form electrical connections with corresponding contacts in a connector insert when the connector insert is inserted into first connector receptacle 110. Contacts 114 and 115 may terminate in through-hole contact portions 116 and 118. The second or lower housing 101 may include a second connector receptacle 120. Second connector receptacle 120 may include tongue 122. Tongue 122 may support a number of contacts 124 on a top side and a number of contacts 123 on a bottom side. Contacts 124 and 123 may include contacting portions on tongue 122. Contact portions of contacts 124 and 123 may form electrical connections with corresponding contacts in a connector insert when the connector insert is inserted into second connector receptacle 120. Contacts 124 and 123 may terminate in through-hole contact portions 125 and 127. Second connector receptacle 120 may include EMI ground contacts 128 and 126.

First connector receptacle 110 may further include an assembly comprising a number of housing portions around contacts 114 and a number of housing portions around contacts 115. In this specific embodiment, three housing portions, housing portion 210, housing portion 220, and housing portion 230 may be formed around each of contacts 114. Similarly, housing portion 212, housing portion 222, and housing portion 232 may be formed around each of contacts 115. Housing portion 210 may be separate from housing portion 220, which may in turn be separate from housing portion 230. Similarly, housing portion 212 may be separate from housing portion 222, which may in turn be separate from housing portion 232. Housing portion 210 may be at least approximately orthogonal to housing portion 230, while housing portion 212 may be at least approximately orthogonal to housing portion 232. Intermediary housing portions 220 and 222 may be at an oblique angle between housing portions 210 and 230, and housing portions 212 and 232, respectively. In a specific embodiment of the present invention, housing portions 210 and 212 are joined using posts and corresponding holes or openings, and housing portions 230 and 232 are similarly joined using posts and corresponding holes or openings, while housing portions 220 and 222 are separate. In other embodiments of the present invention, these various housings may be separate or joined in various ways.

Again, it may be difficult to align through-hole contact portions of first connector receptacle 110 to through-hole contact portions of second connector receptacle 120. By employing these assemblies having multiple housings, housings 230 and housing 232 may be free to move relative to second housing 101. This may facilitate the alignment of through-hole contact portions 116 and 118 to through-hole contact portions 125 and 127. This alignment may be enabled by the ability of housing portions 230 and 232 to move relative to second housing 101 in vertical, rotational, and both lateral directions.

It may be difficult to electrically isolate contacts in a first connector receptacle 110 from contacts in a second connector receptacle 120 in a combined connector receptacle. Accordingly, embodiments of the present invention may include shielding between the two connector receptacles 110 and 120. In this example, shield 200 may have a first horizontal portion between contacting portions of contacts 114 and 115 in first connector receptacle 110 and contacting portions of contacts 124 and 123 in second connector receptacle 120. Shield 200 may further include a second vertical portion terminating in tab 202. This second vertical portion may be placed between through-hole contact portions 116 and 118 of first connector receptacle 110 and through-hole contact portions 125 and 127 of second connector receptacle 120.

Shield 130 may substantially surround first or upper housing 100 and second or lower housing 101. Shield 130 may electrically connect to shield 200. Shield 130 may further include tabs 132. Tabs 132 may be inserted into openings in a printed circuit board or other appropriate substrate. Second housing 101 may include post 102 for mechanical alignment. Again, post 102 may be inserted into a corresponding opening in a printed circuit board or other appropriate substrate.

Again, it may be difficult to be able to insert through-hole contact portions 116, 118, 125, and 127, along with tabs 132 and 202, into a printed circuit board without bending or crushing any of them. Accordingly, embodiments of the present invention may include an organizer 300. One or more through-hole contact portions 116 or 118 of the first connector receptacle 110 and one or more through-hole contact portions 125 or 127 of the second connector receptacle 120 may pass through organizer 300. Organizer 300 may help keep these through-hole contact portions aligned during insertion into a printed circuit board or other appropriate substrate.

Figure 3:
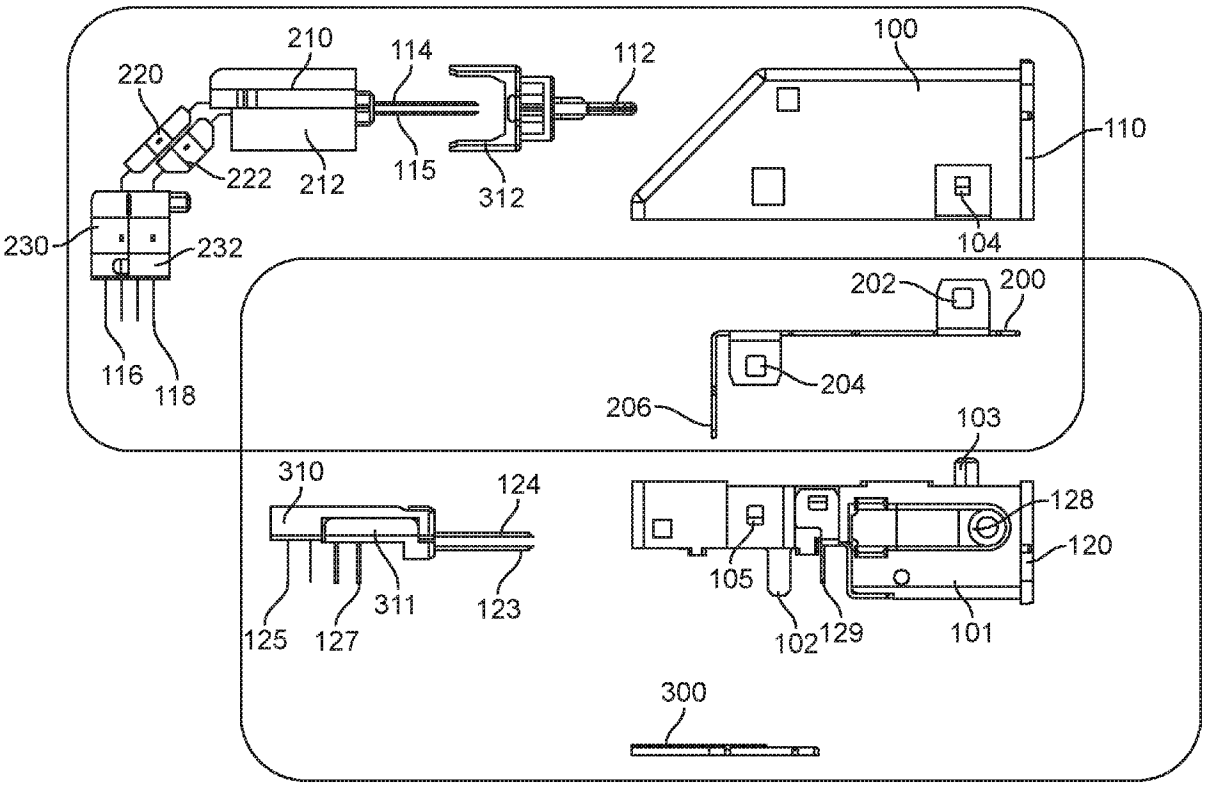
FIG. 3 illustrates a partially exploded view of a combined connector receptacle according to an embodiment of the present invention.

FIG. 3 illustrates a partially exploded view of a combined connector receptacle according to an embodiment of the present invention. Again, this combined connector receptacle may include a first housing 100 for a first connector receptacle 110. The combined connector receptacle may include a second housing 101 for a second connector receptacle 120.

The first connector receptacle 110 may include tongue housing 312 supporting tongue 112. The first connector receptacle 110 may further include an assembly comprising a number of housing portions around contacts 114 and 115. Specifically, housing portion 210, housing portion 220, and housing portion 230 may be formed around portions of contacts 114. Contacts 114 may terminate in through-hole contact portions 116. Housing portion 212, housing portion 222, and housing portion 232 may be formed around portions of contacts 115. Contacts 115 may terminate in through-hole contact portions 118. During assembly, contacts 114 and 115 may be inserted into tongue housing 312 such that they reside on tongue 112. Tongue housing 312 may be inserted into an opening in first housing 100. The opening in first housing 100 may include a number of crush ribs to secure tongue housing 312 in place.

Second connector receptacle 120 may include housing portion 310 supporting contacts 124, which may terminate in through-hole contact portions 125, and housing portion 311 supported contacts 123, which may terminate in through-hole contact portions 127. Housing portion 310 and 311 may be attached and inserted into second housing 101, such that contacts 124 and 123 reside on tongue 112. Second connector receptacle 120 may include side ground or EMI contacts 128. First connector receptacle 110 may be isolated from second connector receptacle 120 by Shield 200. Shield 200 may include tabs 202 to mate with tabs 104 on first housing 100. Shield 200 may also include tabs 204 to mate with tabs 105 on second housing 101. Post 103 on second housing 101 may fit in an opening (not shown) in first housing 100 to secure the two housing portions together.

As before, one or more through-hole contact portions 116 or 118 of first connector receptacle 110 may pass through organizer 300. Similarly, at least one of through-hole contact portions 125 or 127 may pass through organizer 300. This may help to align these through-hole contact portions during the assembly of this combined connector receptacle.

Again, it may be difficult to align the many through-hole contact portions of a combined connector receptacle to each other such that they may be inserted into corresponding openings in a printed circuit board or other appropriate substrate during assembly of the electronic device. An example of an organizer that may be employed by an embodiment of the present invention is shown in the following figure.

Figure 4:
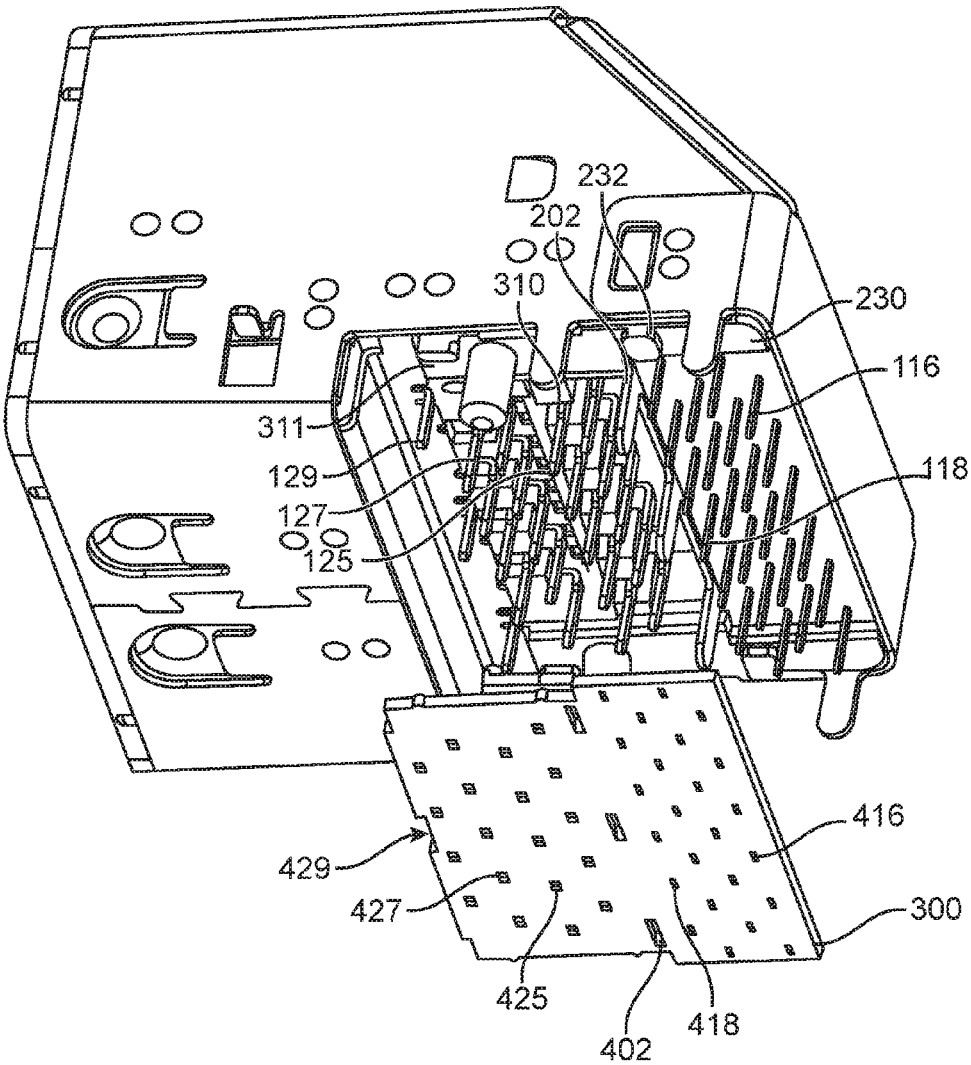
FIG. 4 illustrates a connector receptacle and a through-hole contact portion organizer according to an embodiment of the present invention.

FIG. 4 illustrates a connector receptacle and a through-hole contact portion organizer according to an embodiment of the present invention. This example may include a combined connector receptacle having through-hole contact portions 116 and 118 for a first connector receptacle 110 (as shown in FIG. 1), and through-hole contact portions 125 and 127 of second connector receptacle 120 (as shown in FIG. 1.) Specifically, contacts 116 may emerge from housing portion 230, through-hole contact portions 118 may emerge from housing portion 232, through-hole contact portions 125 may emerge from housing portion 310, and through-hole contact portions 127 may emerge from housing portion 311. Emerging from the underside of the combined connector receptacle along with these through-hole contact portions are shield tabs 202 and 129.

Given this large number of through-hole contact portions and shield tabs, it may be very difficult to insert them all into corresponding holes of a printed circuit board or other appropriate substrate without crushing or otherwise damaging any of them. Accordingly, embodiments of the present invention may include organizer 300. Organizer 300 may include openings 416 for through-hole contact portions 116, openings 418 for through-hole contact portions 118, openings 425 for through-hole contact portions 125, openings 427 for through-hole contact portions 127, openings 402 for tabs 202, and notches 429 for tabs 129. Organizer 300 may provide the alignment and mechanical support for these through-hole contact portions and tabs during insertion into a printed circuit board or other appropriate substrate.

Figure 5:
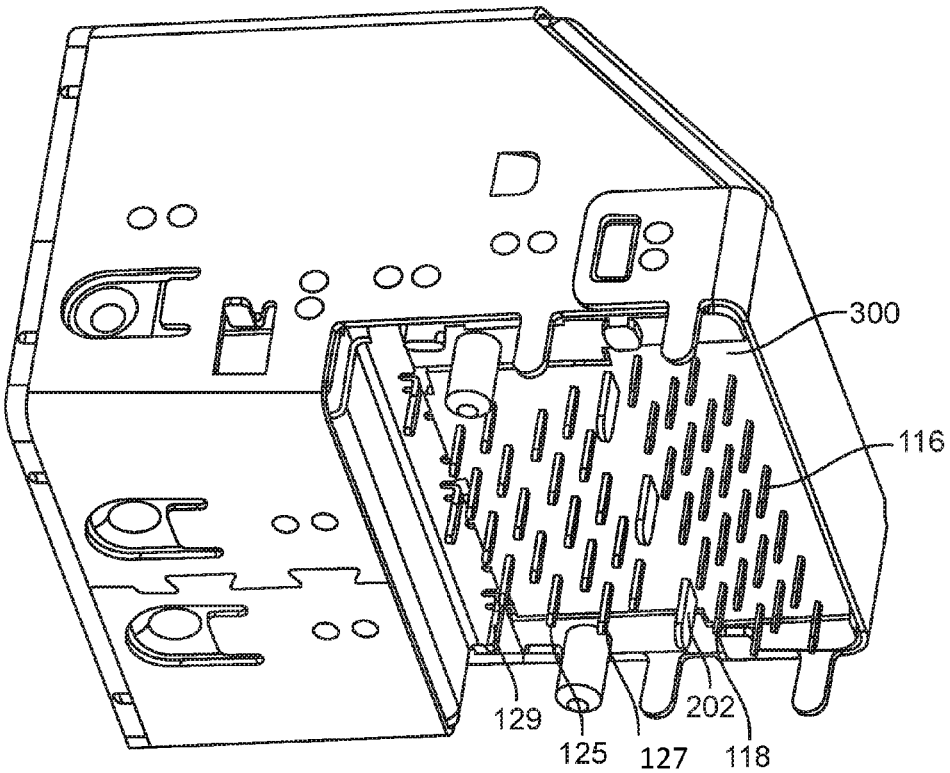
FIG. 5 illustrates an underside of a combined connector receptacle with a through-hole contact portion organizer in place.

FIG. 5 illustrates an underside of a combined connector receptacle with a through-hole contact portion organizer in place. Again, organizer 300 may have openings to allow passage of one or more through-hole contact portions 116 or 118 of a first connector receptacle 110 (as shown in FIG. 2), and one or more through-hole contact portions 125 or 127 of second connector receptacle 120 (as shown in FIG. 2.) Tabs 202 and 129 may fit in openings or notches in organizer 300.

Figure 6:
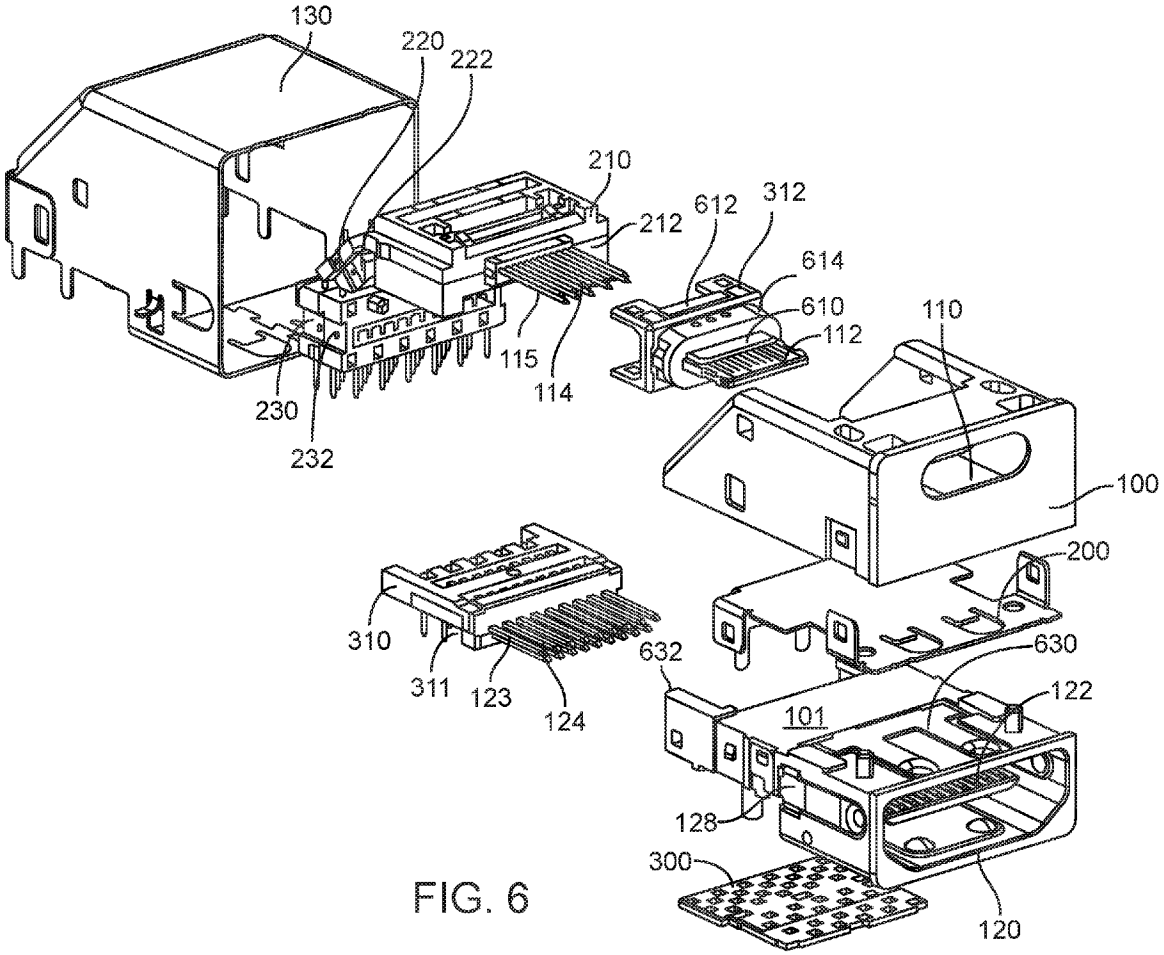
FIG. 6 illustrates an exploded view of a combined connector receptacle according to an embodiment of the present invention.

FIG. 6 illustrates an exploded view of a combined connector receptacle according to an embodiment of the present invention. First housing 100 may support a first connector receptacle 110. First connector receptacle 110 may include tongue housing portion 312. Tongue housing portion 312 may include tongue 112. Tongue 112 may support ground contacts 610. Tongue housing portion 312 may further include a joining portion 614 having ground connections 612. Ground connections 612 may be soldered or laser-welded to a top of shield 130. First connector receptacle 110 may further include an assembly including housing portions 210, 220, and 230 formed around contacts 114, and housing portions 212, 222, and 232 formed around contacts 115. During assembly, contacts 114 and 115 may be inserted into tongue housing portion 312. Tongue housing portion 312 may then be inserted into an opening in first housing 100.

Second housing 101 may support second connector receptacle 120. Second connector receptacle 120 may include contacts 123 and 124 supported by housing portions 311 and 310, respectively. During assembly, contacts 124 and 123 may be inserted into second connector receptacle 120 such that they reside on tongue 122. Second connector receptacle 120 may further include ground contacts structures 128 and 630. Ground contacts structure 630 may be soldered or laser welded to shield 200, while side ground contacts 128 may be soldered or laser welded to sides of shield 130. Shield 200 may be located between first housing 100 and second housing 101. Shield 130 may substantially surround the first connector receptacle 110 and second connector receptacle 120. Organizer 300 may include passages for through-hole contact portions of contacts in the first connector receptacle 110 and second connector receptacle 120.

Figure 7:
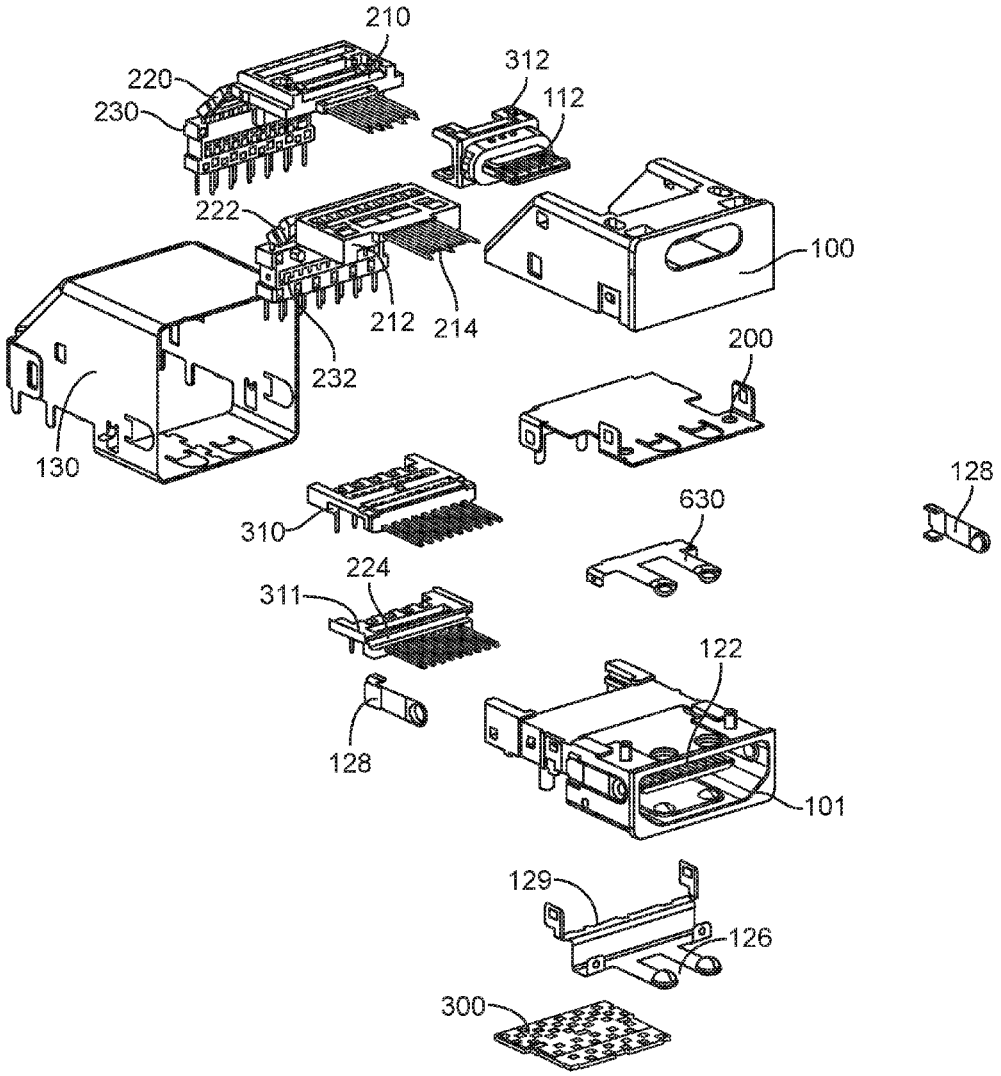
FIG. 7 illustrates a further exploded view of a combined connector receptacle according to an embodiment of the present invention.

FIG. 7 illustrates a further exploded view of a combined connector receptacle according to an embodiment of the present invention. In this figure, housing portions 210, 220, and 230 are shown as separate from housing portions 212, 222, and 232. In various embodiments of the present invention, housing portion 210 may be free to move relative to housing portion 212, though in other embodiments of the present invention, attachment features, such as posts and corresponding openings, may be used to fix these two housing portions together. Similarly, in other embodiments of the present invention, housing portion 230 may be free to move relative to housing portion 232, though in other embodiments of the present invention, attachment features, such as posts and corresponding openings, a be used to fix these two housing portions together. Typically, intermediate housing portions 220 and 222 are not attached and are free to move relative to each other, though in other embodiments the present invention, these may be fixed to each other as well.

Also in this figure, housing portions 310 and 311 are shown as separate housing portions. As with other housing portions, various posts and corresponding openings may be used to attach these two housing portions to each other.

Again, ground contact portion 630 may be soldered or laser welded to shield 200. Side ground contacts 128 may be soldered or laser welded to sides of shield 130. Similarly, sides of shield 200 may be soldered or laser welded to sides of shield 130. Sides of bottom ground contact structure 126 may similarly be soldered or laser welded to sides of shield 130. In this arrangement, shield 130 may provide electrical isolation between the combined connector receptacle and other components in an electronic device, shield 200 may provide isolation between first connector receptacle 110 and second connector receptacle 120, while ground contacts structures 630, 126, and 128 may provide in EMI ground contacts for the second connector receptacle 120. An organizer 300 may include openings for through-hole contact portions for contacts in the first connector receptacle 110 and second connector receptacle 120.

In various embodiments of the present invention, the organizer may be installed flush to a bottom surface of a combined connector receptacle. In other embodiments of the present invention, the organizer may be installed a distance away from the bottom surface of the combined connector receptacle. In this embodiment, as the combined connector receptacle is installed, a printed circuit board or other appropriate substrate may push the organizer such that it is, or is nearly, flush with the bottom side of the combined connector receptacle after insertion. An example is shown in the following figure.

Figure 8:
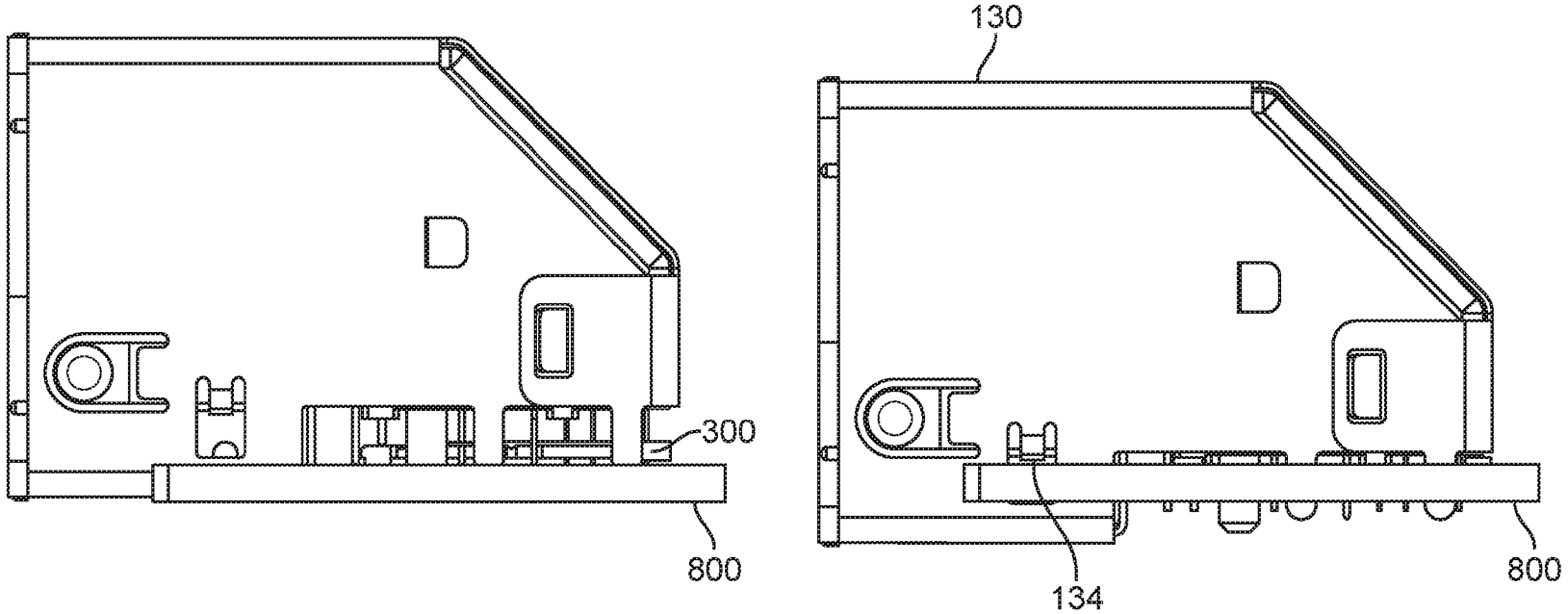
FIG. 8 illustrates a combined connector receptacle and organizer according to an embodiment of the present invention.

FIG. 8 illustrates a combined connector receptacle and organizer according to an embodiment of the present invention. In an initial state, organizer 300 may be installed a distance away from a bottom side of the combined connector receptacle. The combined connector receptacle may be in the process of being inserted into a printed circuit board or other appropriate substrate 800. In a final state, the combined connector receptacle may be inserted into the printed circuit board or other appropriate substrate 800. In this final state, organizer 300 may be obscured by shield 130 of the combined connector receptacle. Tab 134 may be used to control a height of the insertion of the combined connector receptacle into printed circuit board 800. In other embodiments of the present invention, organizer 300 may be flush, or nearly flush, with an underside of the combined connector receptacle before the combined connector receptacle is mated with printed circuit board or other appropriate substrate 800.

In various embodiments of the present invention, contacts, shields, and other conductive portions of combined connector receptacles may be formed by stamping, metal-injection molding, machining, micro-machining, 3-D printing, forging, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide combined connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These combined connector receptacles may provide pathways for signals that are compliant with various standards such as one of the Universal Serial Bus (USB) standards including USB-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A combined connector receptacle comprising:

a first connector receptacle having a first plurality of contacts, each having a contacting portion at a first end and a through-hole contact portion at a second end, the though-hole contact portion extending from a bottom surface of a first housing;

a second connector receptacle having a second plurality of contacts, each having a contacting portion at a first end and a through-hole contact portion at a second end, the though-hole contact portion extending from a bottom surface of a second housing, where the bottom surface of the first housing and the bottom surface of the second housing are co-planar; and an organizer having a first plurality of openings and a second plurality of openings, a through-hole contact portion of each of the first plurality of contacts of the first connector receptacle passing through a corresponding opening in the first plurality of openings and a through-hole contact portion of each of the second plurality of contacts of the second connector receptacle passing through a corresponding opening in the second plurality of openings.

2. The combined connector receptacle of claim 1 wherein the first connector receptacle further comprises the first housing around a portion of each of the first plurality of contacts and the second connector receptacle further comprises the second housing around a portion of each the second plurality of contacts.

3. The combined connector receptacle of claim 2 wherein the first connector receptacle further comprises a third plurality of contacts, each having a contacting portion at a first end and a through-hole contact portion at a second end, and a third housing around a portion of each the third plurality of contacts.

4. The combined connector receptacle of claim 3 wherein the organizer has a third plurality of openings, a through-hole contact portion of each of the third plurality of contacts of the first connector receptacle passing through a corresponding opening in the third plurality of openings.

5. The combined connector receptacle of claim 2 further comprising a first shield between the first connector receptacle and the second connector receptacle.

6. The combined connector receptacle of claim 5 wherein the first shield comprises a first tab, the organizer having a fourth opening, the first tab passing through the fourth opening.

7. The combined connector receptacle of claim 6 further comprising a second shield substantially around the first connector receptacle and the second connector receptacle, wherein the first shield is connected to the second shield.

8. The combined connector receptacle of claim 2 wherein the first connector receptacle further comprises a third housing around each the first plurality of contacts and a fourth housing around each the first plurality of contacts, wherein the first, third, and fourth housings are not in contact with each other.

9. A combined connector receptacle comprising:

a first connector receptacle comprising a first assembly including a first plurality of contacts positioned in a first housing portion, a second housing portion, and a third housing portion, wherein the first housing portion and the second housing portion are orthogonal and the third housing portion is between and at an oblique angle to the first housing portion and the second housing portion; and a second connector receptacle comprising a second assembly including a second plurality of contacts positioned in a fourth housing portion.

10. The combined connector receptacle of claim 9 further comprising an organizer having a first plurality of openings for through-hole contact portions of the first plurality of contacts and a second plurality of openings for through-hole contact portions of a the second plurality of contacts.

11. The combined connector receptacle of claim 10 wherein the first housing portion, the second housing portion, and the third housing portion do not contact each other.

12. The combined connector receptacle of claim 11 wherein the third housing portion may move relative to the fourth housing portion.

13. The combined connector receptacle of claim 12 further comprising a first shield having a first portion substantially between the first housing portion, the second housing portion, and the fourth housing portion, the first shield having a second portion orthogonal to the first portion and substantially between the third housing portion and the fourth housing portion.

14. The combined connector receptacle of claim 13 wherein the second portion of the first shield comprises a first tab, the organizer having a third opening, the first tab passing through the third opening.

15. The combined connector receptacle of claim 14 further comprising a second shield substantially around the first connector receptacle and the second connector receptacle, wherein the first shield is connected to the second shield.

16. A combined connector receptacle comprising:

a first connector receptacle comprising a first assembly including a first plurality of contacts each having a contacting portion at a first end and a through-hole contact portion at a second end, the contacting portion and a through-hole contact portion orthogonal to each other;

a second connector receptacle comprising a second assembly including a second plurality of contacts each having a contacting portion at a first end and a through-hole contact portion at a second end, the contacting portion and a through-hole contact portion orthogonal to each other; and a first shield between the first connector receptacle and the second connector receptacle, the first shield having a first portion between the contacting portions of the first plurality of contacts and the contacting portions of the second plurality of contacts, the first shield further having a second portion orthogonal to the first portion and between through-hole contact portions of the first plurality of contacts and through-hole contact portions of the second plurality of contacts.

17. The combined connector receptacle of claim 16 further comprising an organizer having a first plurality of openings for through-hole contact portions of the first plurality of contacts and a second plurality of openings for through-hole contact portions of a the second plurality of contacts.

18. The combined connector receptacle of claim 17 wherein the first assembly further comprises a first housing portion, a second housing portion, and a third housing portion, wherein the first housing portion, the second housing portion, and the third housing portion are not in contact with each other.

19. The combined connector receptacle of claim 17 wherein the second portion of the first shield comprises a first tab, the organizer having a third opening, the first tab passing through the third opening.

20. The combined connector receptacle of claim 17 further comprising a second shield substantially around the first connector receptacle and the second connector receptacle, wherein the first shield is connected to the second shield.

21. The combined connector receptacle of claim 1 wherein the organizer has a substantially planar form-factor.

22. The combined connector receptacle of claim 1 wherein the organizer is substantially planar.

* * * * *